US010905261B2

(12) United States Patent
Simmons

(10) Patent No.: US 10,905,261 B2
(45) Date of Patent: Feb. 2, 2021

(54) COLLAPSIBLE WIG STAND

(71) Applicant: Ashlie Simmons, Smiths (BM)

(72) Inventor: Ashlie Simmons, Smiths (BM)

( * ) Notice: Subject to any disclaimer, the term of this patent is extended or adjusted under 35 U.S.C. 154(b) by 89 days.

(21) Appl. No.: 16/163,640

(22) Filed: Oct. 18, 2018

(65) Prior Publication Data

US 2019/0183262 A1 Jun. 20, 2019

Related U.S. Application Data

(60) Provisional application No. 62/608,002, filed on Dec. 20, 2017.

(51) Int. Cl.

| | |
|---|---|
| ***A47F 7/00*** | (2006.01) |
| ***A47F 7/06*** | (2006.01) |
| ***A45D 44/14*** | (2006.01) |

(52) U.S. Cl.

CPC ..... *A47F 7/065* (2013.01); *A45D 44/14* (2013.01)

(58) Field of Classification Search

CPC ... A47F 7/00; A47F 7/065; A47F 7/06; A45D 44/14; A45D 20/24; G09F 19/08; A63H 3/44; A63H 3/46; B65D 85/18; A41H 5/00; A41G 3/00; A41G 3/0041

USPC ..... D28/92, 93

See application file for complete search history.

(56) References Cited

U.S. PATENT DOCUMENTS

| | | | | | |
|---|---|---|---|---|---|
| 1,828,892 | A * | 10/1931 | Felton | E01F 9/65 | 116/173 |
| 3,161,293 | A | 12/1964 | Sander | | |
| 3,515,318 | A * | 6/1970 | Preble | A45D 44/14 | 223/66 |
| 3,568,899 | A | 3/1971 | Rosenberg | | |
| 3,591,118 | A * | 7/1971 | Gentile | A45D 44/14 | 248/231.71 |
| 3,615,046 | A * | 10/1971 | Bashara | A45D 44/14 | 223/66 |
| 3,740,013 | A * | 6/1973 | Bentley | A45D 44/14 | 223/66 |
| 3,741,448 | A | 6/1973 | Friedman et al. | | |
| 3,779,433 | A | 12/1973 | Imai | | |
| 3,861,061 | A * | 1/1975 | Ross | F26B 5/00 | 34/103 |
| 4,470,527 | A * | 9/1984 | Middleton | F16B 7/10 | 223/66 |
| 9,427,066 | B2 | 8/2016 | Davidson | | |
| 9,609,931 | B2 * | 4/2017 | Rosenblatt | A45C 5/08 | |
| 2004/0116042 | A1 * | 6/2004 | Emoff | A63H 3/36 | 446/384 |

* cited by examiner

*Primary Examiner* — Ismael Izaguirre

(74) *Attorney, Agent, or Firm* — Boudwin Intellectual Property; Daniel Boudwin

(57) ABSTRACT

A collapsible wig stand. The collapsible wig stand includes a base having a wire thereon. The wire is coiled about an axis perpendicular to the base and can move between an extended position and a collapsed position. A shroud is affixed to a perimeter of the base about the wire, wherein the shroud is designed to mimic the appearance of a human head, such that a wig can be placed thereon.

11 Claims, 2 Drawing Sheets

COLLAPSIBLE WIG STAND

CROSS REFERENCE TO RELATED APPLICATIONS

This application claims the benefit of U.S. Provisional Application No. 62/608,002 filed on Dec. 20, 2017. The above identified patent application is herein incorporated by reference in its entirety to provide continuity of disclosure.

BACKGROUND OF THE INVENTION

The present invention relates to a wig stand. More specifically, the present invention relates to a collapsible wig stand configured to move between an extended position and a retracted position for portability and storage.

Many people wear wigs to vary their appearance or hairstyle. These wigs must be stored when not in use, however traditional storage solutions include bags, hooks, or other containers, which can often damage or deform the wig over time. These damaged wigs often no longer fit properly, or otherwise reduce the aesthetic appeal of the wig. Often this forces the user to either repair or replace the wig, which can be quite expensive. Other storage solutions include a wig stand in the shape of a human head, allowing a wig to be stored in the same position the wig is in when worn, however these wig stands are often bulky and difficult to transport. This can make it difficult for wig wearers to travel, as the wearer must decide between risking the shape of the wig or transporting large, bulky wig stands. Therefore, a wig stand that emulates the shape of a human head that can collapse for easy transport is desired.

In light of the devices disclosed in the known art, it is submitted that the present invention substantially diverges in design elements from the known art and consequently it is clear that there is a need in the art for an improvement to existing wig stands. In this regard, the instant invention substantially fulfills these needs.

SUMMARY OF THE INVENTION

In view of the foregoing disadvantages inherent in the known types of wig stands now present in the known art, the present invention provides a collapsible wig stand wherein the same can be utilized for providing convenience for the user when transporting and storing a wig stand.

The present system comprises a base having a wire affixed thereto, wherein the wire is coiled about an axis perpendicular to the base. The wire is configured to selectively move between an extended position and a collapsed position. A shroud is affixed to a perimeter of the base and is disposed about the wire, wherein the shroud is configured to resemble a human head when the wire is in the extended position. In some embodiments, the base further comprises a sidewall extending perpendicularly from the perimeter thereof such that an interior volume of the base is formed thereby. In another embodiment, the wire is configured to store within the interior volume when in the collapsed position. In other embodiments, a pair of fasteners are pivotally affixed to the base, wherein the pair of fasteners are configured to secure the wire in the collapsed position. In yet another embodiment, each of the pair of fasteners removably secure to a pair of receiving studs affixed to the shroud. In some embodiments, the pair of receiving studs are affixed to an upper portion of the shroud. In another embodiment, each of the pair of fasteners comprise an arcuate shape. In other embodiments, the wire is spring-biased towards the extended position. In yet another embodiment, the wire rests along a singular plane when in the collapsed position. In some embodiments, the shroud further comprises at least one facial feature thereon. In another embodiment, a central portion of the shroud comprises a lesser diameter than each of an upper portion of the shroud and a lower portion of the shroud.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
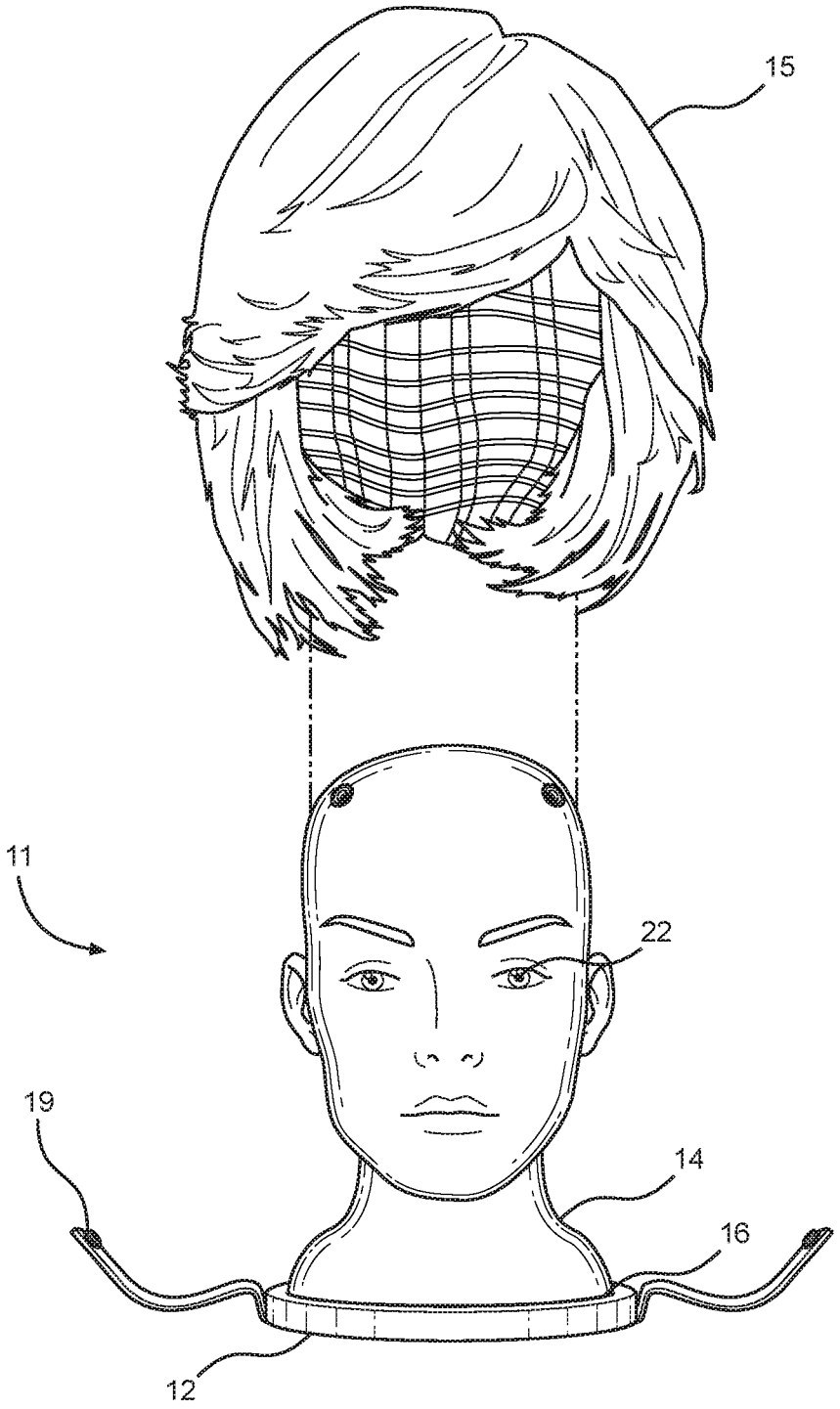
FIG. 1 shows an exploded view of an embodiment of the collapsible wig stand receiving a wig thereon.

Reference is made herein to the attached drawings. Like reference numerals are used throughout the drawings to depict like or similar elements of the collapsible wig stand. The figures are intended for representative purposes only and should not be considered to be limiting in any respect.

Figure 2:
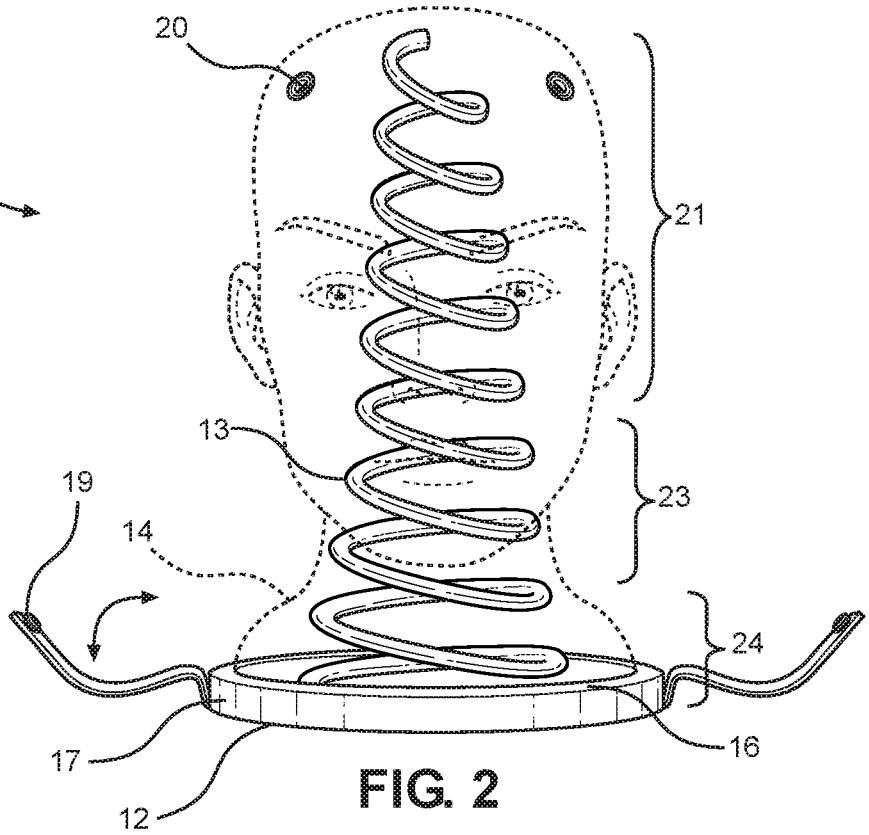
FIG. 2 shows a semi-transparent view of an embodiment of the collapsible wig stand in the extended position.

Referring now to FIG. 1, there is shown an exploded view of an embodiment of the collapsible wig stand receiving a wig thereon. The wig stand 11 comprises a base 12 having a shroud 14 affixed thereto. A wig 15 is configured to be received on the wig stand 11 along an upper portion (as shown in FIG. 2, 21) of the shroud 14. The shroud 14 is affixed to the base 12 about a perimeter 16 of the base 12, such that a wire (as shown in FIG. 2, 13) is encompassed thereby. A pair of fasteners 19 are pivotally affixed to the base 12, wherein the pair of fasteners 19 are configured to secure the wig stand 11 in a collapsed position. The shroud 14 is configured to replicate the appearance of a human head, allowing the user to store the wig 15 on the wig stand 11 in a position of typical use, such that the wig 15 is not damaged or deformed. In the illustrated embodiment, the shroud 14 further comprises at least one facial feature 22 thereon, the facial features 22 configured to replicate the appearance of a human head, thereby providing the user with a visual guide as to the correct orientation for the wig 15 on the wig stand 11. Additionally, the facial features 22 allow the user to estimate how the wig 15 would appear when worn, allowing the user to properly maintain or otherwise alter the wig 15 to the user's desired aesthetic preferences.

Figure 3:
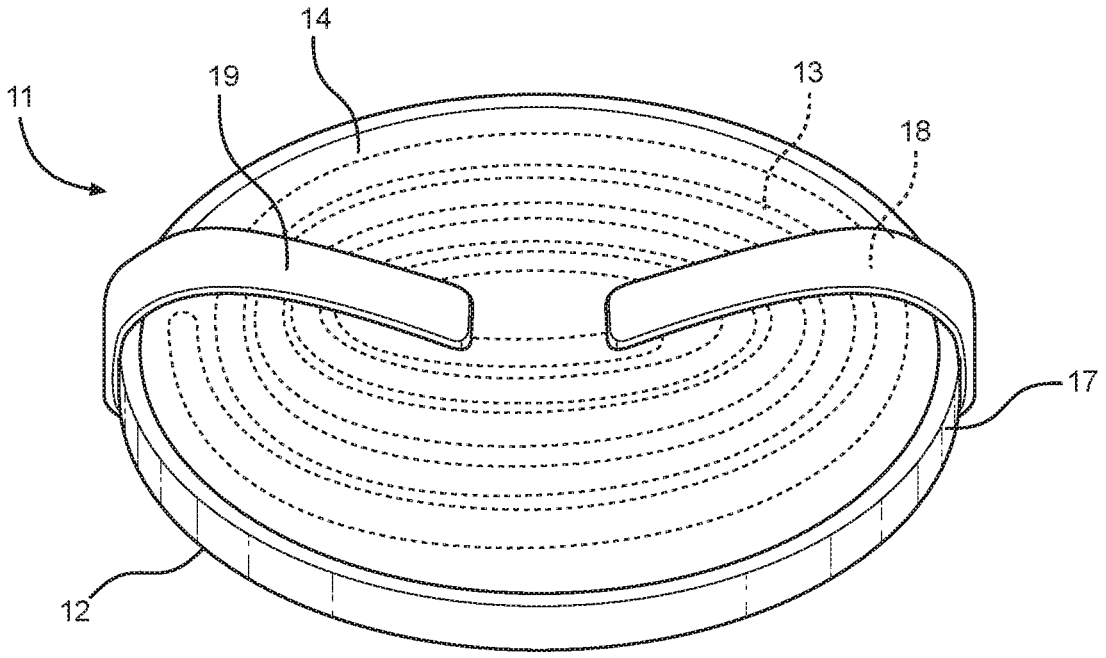
FIG. 3 shows a perspective view of an embodiment of the collapsible wig stand in the collapsed position.

Referring now to FIG. 2, there is shown a semi-transparent view of an embodiment of the collapsible wig stand in the extended position. In the illustrated embodiment, the base 12 further comprises a sidewall 17 extending perpendicularly away from the perimeter 16 thereof, thereby forming an interior volume (as shown in FIG. 3, 18) therein. The wire 13 is affixed to the base 12 within the interior volume and is coiled about an axis perpendicular to that of the base 12. In this way, the wire 13 is configured to selectively move between an extended position and a collapsed position (as shown in FIG. 3). In some embodiments, the wire 13 is spring-biased towards the extended position, such that the wig stand 11 defaults to a position of use.

The shroud 14 is configured to move along with the wire 13, such that the shroud 14 replicates the shape of a human head when the wire 13 is in the extended position. In some embodiments, the shroud 14 is affixed to a distal end of the wire 13, such that the shroud 14 is not damaged by the wire 13 during movement thereof. Additionally, in some embodiments, the shroud 14 comprises a total height equal to that of the wire 13 when the wire 13 is in the extended position, such that the shroud 14 maintains the desired shape when the wire 13 is in the extended position. When in the extended position, the shroud 14 comprises a lower portion 24, a central portion 23, and an upper portion 21, wherein the lower portion 24 corresponds to the shoulders of a human, the central portion 23 corresponds to the neck of a human, and the upper portion 21 corresponds to the head of a human. In this way, a diameter of the central portion 23 is less than that of both the upper portion 21 and the lower portion 24, allowing the wig stand 11 to replicate a human shape.

The pair of fasteners 19 are pivotally secured to the sidewall 17, such that the pair of fasteners 19 are configured retain the wire in the collapsed position when secured thereto. In the illustrated embodiment, the shroud 14 further comprises a pair of receiving studs 20 disposed along the upper portion 21 thereof. The pair of fasteners are configured to removably secure to the pair of receiving studs 20, such that the wire 13 is retained in the collapsed position thereby. When the pair of fasteners 19 are not affixed to the pair of receiving studs 20, the wire 13 is not restrained and defaults to the extended position. In the illustrated embodiment, the pair of fasteners 19 comprise an arcuate shape, such that a distal end of each fastener 19 exerts a downward force on the wire 13 when secured to the shroud 14, thereby retaining the wire 13 in the collapsed position.

Referring now to FIG. 3, there is shown a perspective view of an embodiment of the collapsible wig stand in the collapsed position. In the illustrated embodiment, the wire 13 is shown in the collapsed position, wherein the wire 13 occupies a single plane when in the collapsed position. In this way, the wire 13 and the shroud 14 are contained entirely within the interior volume 18 of the base 12, thereby providing a minimal form factor. This allows for maximal convenience in transporting and storing the wig stand 11 during travel or other uses. In the illustrated embodiment, the pair of fasteners 19 are shown in the secured position affixed to the shroud 14, such that the wire 13 is retained in the collapsed position thereby.

In one exemplary use, the user can remove the wig stand 11 from storage and release the pair of fasteners 19 such that the wire 13 extends such that the shroud 14 resembles a human head. The user can then place a wig onto the wig stand 11 for storage when not in use. The shape of the shroud 14 allows the wig to be stored in a position similar to that when the wig is in use, thereby minimizing the potential for damage during storage, such as deformations caused by extended storage on hooks or in bags. Alternatively, the user can style and maintain the wig while stored on the wig stand 11 to represent the user's desired aesthetic appeal for the wig. Using the facial features disposed on the shroud 14, the user can gauge how the wig would appear when worn without having to repeatedly remove and wear the wig for comparison purposes between each styling change. In this way, potential damage to the wig caused by excessive use can be minimized. When the user is wearing the wig, or when the user wishes to transport the wig stand 11 to another location, the user can then move the wire 13 to the collapsed position and secure the pair of fasteners 19 to the shroud, such that the wire 13 is retained thereby. In this way, the form factor of the wig stand 11 is minimized allowing easy and efficient transportation and storage.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible wig stand, comprising:

a base having a wire affixed thereto;

wherein the wire is coiled about an axis perpendicular to the base;

wherein the wire is configured to selectively move between an extended position and a collapsed position;

a shroud affixed to a perimeter of the base and disposed about the wire;

wherein the shroud is configured to resemble a human head when the wire is in the extended position;

wherein a pair of fasteners are pivotally affixed to the base, the pair of fasteners configured to secure the wire in the collapsed position.

2. The collapsible wig stand of claim 1, wherein the base further comprises a sidewall extending perpendicularly away from the perimeter thereof, such that an interior volume of the base is formed thereby.

3. The collapsible wig stand of claim 2, wherein the wire is configured to store within the interior volume when in the collapsed position.

4. The collapsible wig stand of claim 1, wherein each of the pair of fasteners removably secure to one of a pair of receiving studs affixed to the shroud.

5. The collapsible wig stand of claim 4, wherein the pair of receiving studs are affixed to an upper portion of the shroud.

6. The collapsible wig stand of claim 1, wherein each of the pair of fasteners comprise an arcuate shape.

7. The collapsible wig stand of claim 1, wherein the wire is spring-biased towards the extended position.

8. The collapsible wig stand of claim 1, wherein the wire rests along a singular plane when in the collapsed position.

9. The collapsible wig stand of claim 1, wherein the shroud further comprises at least one facial feature thereon.

10. The collapsible wig stand of claim 1, wherein a central portion of the shroud comprises a lesser diameter than each of an upper portion of the shroud and a lower portion of the shroud.

11. A collapsible wig stand, comprising:

a base having a wire affixed thereto;

wherein the wire is coiled about an axis perpendicular to the base;

wherein the wire is configured to selectively move between an extended position and a collapsed position;

wherein the wire rests along a singular plane when in the collapsed position;

a shroud affixed to a perimeter of the base and disposed about the wire;

wherein the shroud is configured to resemble a human head when the wire is in the extended position.

* * * * *